US006284128B1

(12) United States Patent
Glover et al.

(10) Patent No.: US 6,284,128 B1
(45) Date of Patent: Sep. 4, 2001

(54) REFORMING WITH SELECTIVE REFORMATE OLEFIN SATURATION

(75) Inventors: Bryan K. Glover, Algonquin; Aronson L. Huebner, Palatine, both of IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 09/388,960

(22) Filed: Sep. 2, 1999

(51) Int. Cl.[7] ..... C10G 35/085

(52) U.S. Cl. ..... 208/66; 208/137; 208/138; 208/141; 208/142; 208/143; 208/144; 208/145; 208/62; 208/63; 208/64; 208/65; 208/66; 585/258

(58) Field of Search ..... 208/137, 138, 208/141–144, 145, 62–66; 585/258

(56) References Cited

U.S. PATENT DOCUMENTS

| | | | | |
|---|---|---|---|---|
| 3,442,792 | * | 5/1969 | Eng et al. | 208/62 |
| 3,835,037 | | 9/1974 | Fairweather et al. | 208/260 |
| 3,869,377 | | 3/1975 | Eisenlohr et al. | 208/66 |
| 4,457,832 | * | 7/1984 | Robinson | 208/66 |
| 4,911,822 | * | 3/1990 | Franck et al. | 208/66 |
| 5,015,794 | | 5/1991 | Reichmann | 585/258 |
| 5,472,593 | * | 12/1995 | Gosling et al. | 208/65 |
| 5,658,453 | | 8/1997 | Russ et al. | 208/62 |
| 5,792,338 | * | 8/1998 | Gosling et al. | 208/65 |

FOREIGN PATENT DOCUMENTS 1513014 7/1989 (SU) .

OTHER PUBLICATIONS

"Chemical Refining of Petroleum", Kalichevsky et al., p. 236, lines 23–29, 1942 no month.*

"Petroleum Refinery Engineering", Nelson, pp. 15–17 and p. 811, Table 21–24, 1958 no month.*

* cited by examiner

*Primary Examiner*—Nadine Preisch
(74) *Attorney, Agent, or Firm*—John G. Tolomei; John F. Spears, Jr.

(57) ABSTRACT

A process combination is disclosed to selectively upgrade hydrocarbons in a manner to essentially eliminate olefins in product from the combination. Preferably the hydrocarbons comprise naphtha which is reformed to upgrade its octane number and/or to produce aromatic intermediates, followed by hydrogenation of olefins in the reformate. Olefin saturation optimally is effected by catalytic reaction on an olefin-containing reformate taken at an intermediate point from the effluent side of the reforming-process feed-effluent heat exchanger. Saturation is performed in a defined temperature range which results in selective hydrogenation.

7 Claims, 2 Drawing Sheets

REFORMING WITH SELECTIVE REFORMATE OLEFIN SATURATION

BACKGROUND OF THE INVENTION

1. Field of the Invention

This invention relates to an improved process combination for the conversion of hydrocarbons, and more specifically for the upgrading of catalytic-reformate quality.

2. General Background

The widespread removal of lead antiknock additive from gasoline and the rising fuel-quality demands of high-performance internal-combustion engines have compelled petroleum refiners to install new and modified processes for increased "octane," or knock resistance, in the gasoline pool. Refiners have relied on a variety of options to upgrade the gasoline pool, including higher-severity catalytic reforming, higher FCC (fluid catalytic cracking) gasoline octane, isomerization of light naphtha and the use of oxygenated compounds. Growing demand for high-purity aromatics as petrochemical intermediates also is a driving force for the upgrading of naphtha.

Catalytic reforming is a major focus, as this process generally supplies 30–40% or more of the gasoline pool and is the principal source of benzene, toluene and xylenes for chemical syntheses. Increased reforming severity often is accompanied by a reduction in reforming pressure in order to maintain yield of gasoline-range product from the reforming unit. Both higher severity and lower pressure promote the formation of olefins in reforming, and the 1–2+% of olefins in modern reformates contribute to undesirable gum and high endpoint in gasoline product and to particularly troublesome impurities in recovered high-purity aromatics streams.

Reformate and aromatics extracts recovered from reformate often are clay treated to polymerize the small amounts of olefin present [see, e.g., U.S. Pat. No. 3,835,037 (Fairweather et al.)]. This procedure, however, forms a heavy polymer which is an undesirable gasoline component which effects deposits in engines; further, disposal of the spent clay may be difficult and expensive. A problem facing workers in the art, therefore, is to discover a method of olefin removal which does not suffer the above drawbacks.

U.S. Pat. No. 5,658,453 issued to M. B. Russ et al. illustrates the use of an olefin selective saturation catalyst to selectively hydrogenate olefins present in a liquid phase stream recovered from reforming zone effluent stream. This process employs a limited and controlled hydrogen supply to promote selectivity for olefin saturation over aromatics saturation.

Considering selective hydrogenation of olefins, U.S. Pat. No. 3,869,377 (Eisenlohr et al.) teaches elimination of aliphatic unsaturates from a reformate by cooling a reaction mixture from hydroforming which contains hydrogen and aromatics and passing this mixture in gaseous state through a reactor containing a catalyst comprising oxides of Group 6 and/or 8 metals [preferably cobalt and molybdenum]. Russian disclosure SU1513014-A (Maryshev et al.) teaches hydrogenation of reforming products at a temperature of 150°–250° C. in the presence of aluminum-platinum catalysts. Selective hydrogenation of small quantities of alkenes in xylene-isomerization product, using a hydrogenation metal supported on a crystalline borosilicate molecular sieve, is disclosed in U.S. Pat. No. 5,015,794 (Reichmann).

Hydrogenation of olefins by adding a reactor within the hydrogen circuit of an associated unit suffers the disadvantage of adding pressure drop to the circuit, and also does not provide control of the ratio of hydrogen to olefin in the saturation zone.

SUMMARY OF THE INVENTION

It is an object of the present invention to provide an improved process combination to upgrade hydrocarbons by hydroprocessing. A specific object is to reduce the olefin content of catalytic reformate.

This invention is based on the discovery that selective olefin saturation can be integrated into the feed-effluent reforming process heat exchange circuit to effect saturation. This allows operation within a critical temperature range which achieves olefin-reduction objectives with minimal saturation of aromatics despite the presence of large quantities of hydrogen.

A broad embodiment of the present invention is drawn to process combination for upgrading a naphtha feedstock comprising catalytically reforming the feedstock to obtain an olefin-containing reformate, withdrawing reformate from an intermediate point in the reforming process feed-effluent heat exchanger, and contacting the withdrawn reformate with a saturation catalyst at a saturation temperature of from about 600 to 740° K to obtain a saturated reformate. Preferably the critical saturation-zone temperature is defined by:

minimum temperature, $$^{\circ}\,K=\{528/[1-0.021\ \mathrm{In}\ (200*\{H_2\ \text{partial pressure}\}^{3})]\}$$

and maximum temperature, $$^{\circ}\,K=\{827/[1-0.056\ \mathrm{In}\ (0.4*H_2\ \text{partial pressure/mass-\%}\ C_{6+paraffins})]\}.$$

The saturation catalyst comprises a refractory inorganic oxide, preferably comprising alumina, and a platinum-group metal, which preferably is platinum, and optionally a metal modifier.

These, as well as other objects and embodiments, will become apparent from the detailed description of the invention.

DESCRIPTION OF THE PREFERRED EMBODIMENTS

The present invention is broadly directed to a process combination in which a selective olefin-saturation step is integrated with a hydroprocessing step. "Hydroprocessing" in the present sense encompass refinery or petrochemical processes which effect conversion of a feedstock in the presence of free hydrogen. Types of hydroprocessing which could benefit from the inclusion of olefin saturation comprise, without limiting the invention, isomerization, disproportionation, transalkylation, dealkylation, hydrocracking, reforming and dehydrocyclization.

Reforming and/or dehydrocyclization comprise the preferred hydroprocessing step of the present invention. Naphtha is processed in a reforming zone to obtain a reformate product of increased octane number and aromatics content, and is sometimes followed by hydrogenation of olefins in a saturation zone.

Figure 1:
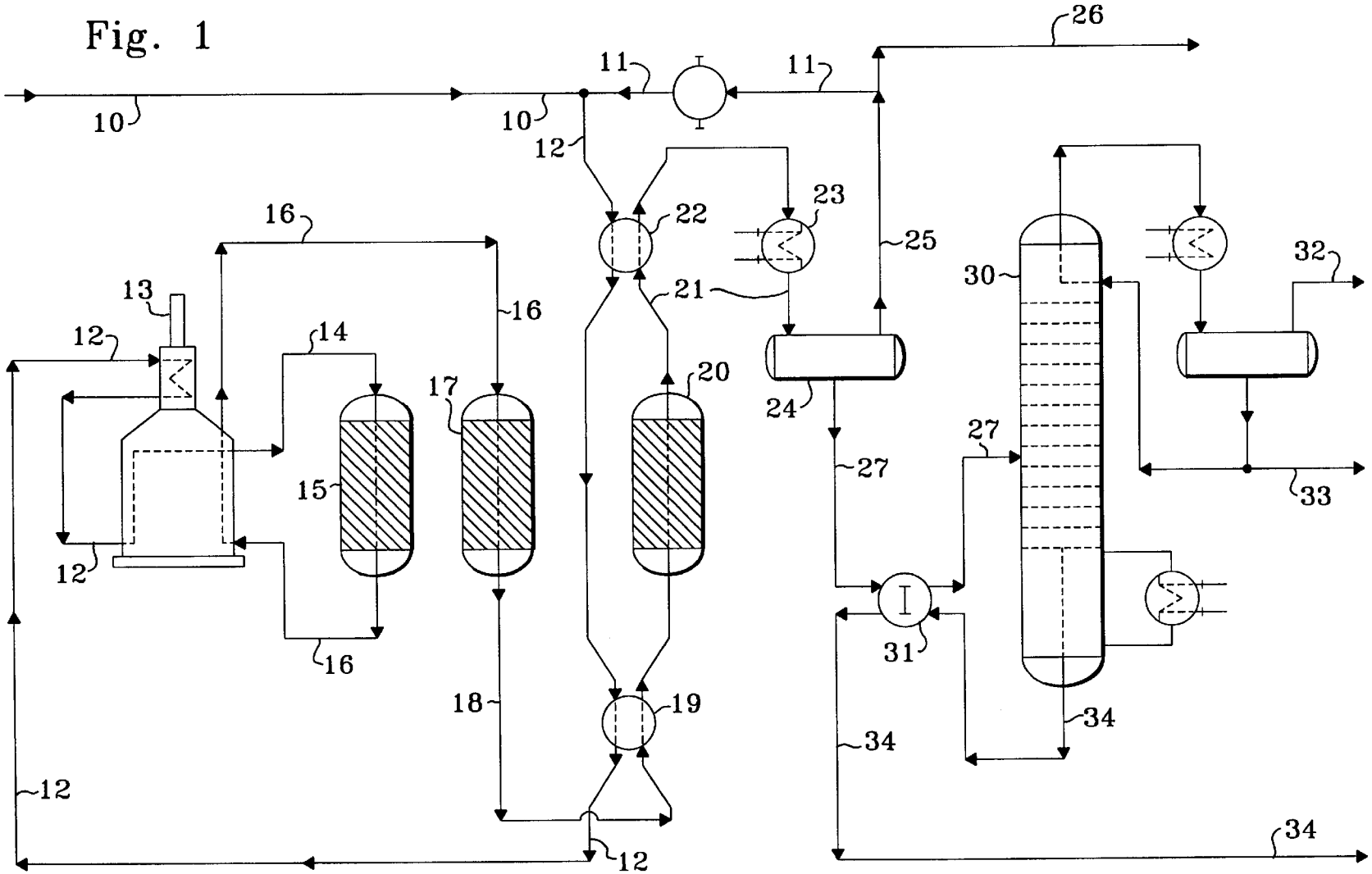
FIG. 1 represents a simplified block flow diagram showing the arrangement of major equipment in a preferred embodiment of the present invention.

The preferred reforming embodiment of the invention is illustrated in simplified form in FIG. 1. This drawing shows the concept of the invention while omitting details known to the skilled routineer, such as appurtenant vessels, minor heat exchangers, piping, pumps, compressors, instruments and other standard equipment.

A naphtha feedstock is introduced into the process combination via line 10, combining with recycled hydrogen-rich gas in line 11 to form combined feed in line 12. The combined feed exchanges heat in the feed-effluent exchanger 22 with cold reactor effluent comprising saturated reformate from a saturation zone. The combined feed then exchanges heat in the feed-effluent exchanger 19 with hot reactor effluent comprising olefin-containing reformate. In this embodiment these two separate heat exchangers are considered parts of a single heat exchange zone. The combined feed then is heated as necessary in heater 13 and passes via line 14 to the first reforming reactor 15. Substantial dehydrogenation of naphthenes takes place in this reactor, along with generally lesser amounts of paraffin dehydrocyclization, isomerization and cracking, and the endothermic dehydrogenation reactions result in a substantial temperature drop. Effluent from the first reactor, therefore, passes through line 16 to the heater which raises the temperature of the reactants to levels which are suitable for further reforming in reactor 17. The sequence of heating and further reaction usually is repeated at least once, and often twice or three times, depending on the feedstock, reaction conditions and resulting balance of endothermic and other reactions in the reforming step.

Effluent from the last reforming reactor comprises olefin-containing reformate and passes via line 18 to feed-effluent exchanger 19 wherein it exchanges heat with the combined feed and is cooled to an appropriate inlet temperature, as disclosed hereinafter, for saturation zone 20. At least a portion and preferably all of the unseparated hydrogen-rich reforming zone effluent is therefore passed into the saturation zone. Effluent from the saturation zone comprises saturated reformate with a reduced olefin content and passes via line 21 through the feed-effluent exchanger 22 and cooler 23 to vapor-liquid separator 24. Cooling, possibly by additional exchangers not shown, is sufficient to condense the great majority of naphtha boiling range hydrocarbons. Separator gas comprises hydrogen along with substantial quantities of light hydrocarbons, most of which is recycled to the reforming zone via line 11. A lesser portion, corresponding nearly to the hydrogen generated by reactions in the reforming reactors, is taken as a net hydrogen-rich gas via line 26. The liquid from the separator in line 27 contains naphtha hydrocarbons and residual light gases, which generally are removed to obtain a gasoline component or feed to further processing steps.

Preferably the separator liquid comprising saturated reformate passes via line 27 to fractionator 30, in which light hydrocarbons and hydrogen are removed overhead to produce a stabilized reformate as bottoms product in line 34. Usually propane and lighter or butanes and lighter components are taken overhead from the fractionator, yielding off-gas via line 32 and net overhead liquid (if any) via line 33. The stabilized reformate in line 34 usually exchanges heat with fractionator feed in exchanger 31.

The hot-section combined-feed exchanger 19 and cold-section combined feed exchanger 22 together correspond to the reformer combined-feed exchanger known in the art. As described above, the saturation reactor derives feed from an intermediate point in the indirect heat exchange train equipment, which is referred to herein as the heat exchange zone.

Figure 2:
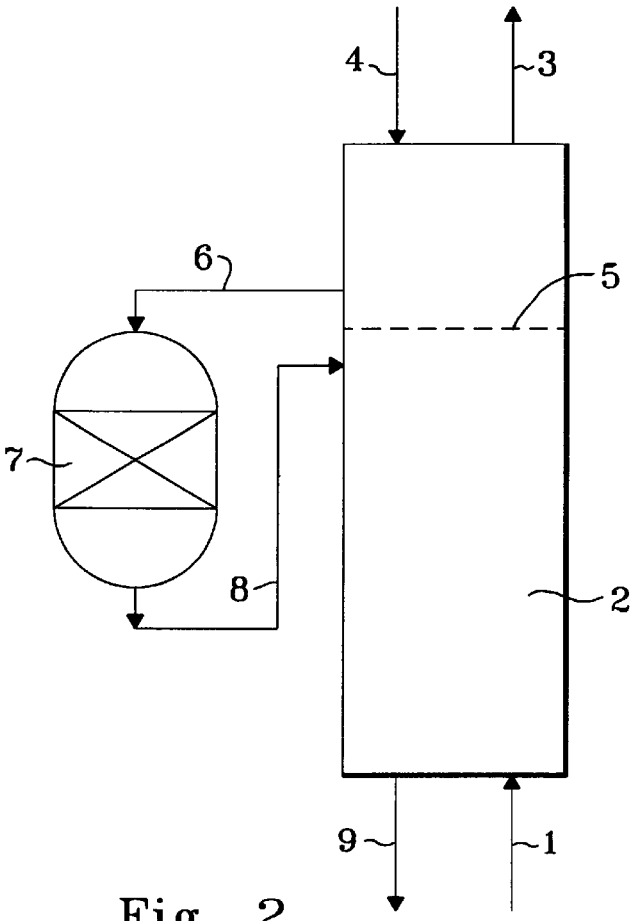
FIG. 2 shows the arrangement of the saturation zone with respect to a segmented combined-feed/effluent exchanger.

An alternative embodiment of the invention is broadly illustrated in FIG. 2. The saturation zone is integrated with a single integral heat exchanger forming the heat exchange zone of the reforming unit. Such exchangers are described in more detail in U.S. Pat. No. 5,091,075, incorporated herein by reference. Combined reforming feed is introduced via line 1 into the feed/effluent exchanger 2, and is heated preferably in the tubes of the exchanger by heat exchange with reactor effluent. Hot combined feed is taken via line 3 to the reforming zone, and effluent from the reforming zone returns to the exchanger in line 4. By means of an effluent-side partition preferably in the shell side of the exchanger, partially cooled effluent is directed via line 6 to the saturation zone 7. Saturated reformate is returned to the feed/effluent exchanger via line 8, and is further cooled before leaving the exchanger via line 9.

Figure 3:
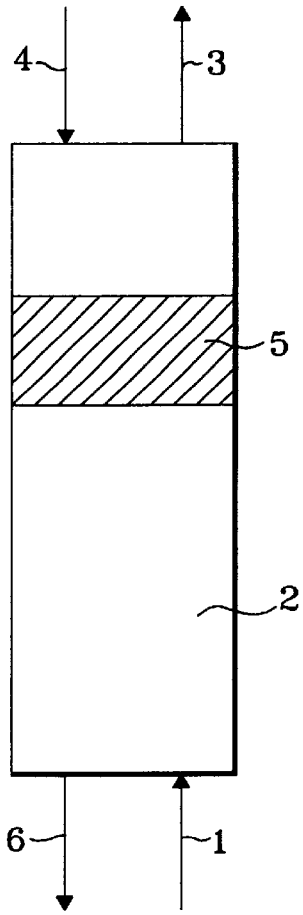
FIG. 3 shows the arrangement of the saturation zone in a combined-feed/effluent heat exchanger having an integral reaction zone.

Yet another embodiment is illustrated in FIG. 3. In this embodiment the saturation zone is an integral part of and contained within the feed/effluent heat exchanger zone. Combined feed is again introduced via line 1 into the feed/effluent exchanger 2 and is heated by indirect heat exchange with reactor effluent. It then passes to the reforming zone via line 3. Reactor effluent returns to the exchanger in line 4, and contacts the saturation catalyst 5 in a separate zone contained within the reactor. Only the reactor effluent passes through the catalyst. The catalyst may be contained within the exchanger by any suitable means such as a bed of catalyst in the shell; in the tubes of the exchanger; or within various structures as used in catalytic distillation and described, e.g., in U.S. Pat. No. 4,731,229; U.S. Pat. No. 5,073,236; U.S. Pat. No. 5,266,546; and U.S. Pat. No. 5,431,890, all incorporated by reference. Saturated reformate subsequently is further cooled by further indirect heat exchange and leaves the exchanger via line 6.

A central component of the subject invention is operation in a limited temperature window which provides essentially automatic selective hydrogenation of olefins. Operation within this temperature window should be facilitated by the design of the heat exchange zone, based upon a knowledge of the operating conditions of the conversion reaction and feed inlet temperature. In addition, portions of the conversion reactor effluent or feed stream can be bypassed around heat exchange surface by conventional means to control the olefin saturation zone operating temperature.

Other hydroprocessing processes which could benefit from the inclusion of olefin saturation comprise, without limiting the invention, isomerization, disproportionation, transalkylation, dealkylation, hydrocracking and dehydrocyclization. Any process which generates undesired olefins during a high temperature reaction is a candidate for this invention. Usually the process combination is integrated into a petroleum refinery comprising crude-oil distillation, cracking, product recovery and other processes known in the art to produce finished gasoline and other petroleum or petrochemical products.

The isomerization of light hydrocarbons such as $C_4$–$C_7$ paraffins, uses catalyst compositions which usually contain a platinum-group metal and a refractory inorganic oxide. Optional components include a Friedel-Crafts metal halide or a zeolitic molecular sieve. An alternative isomerization catalyst comprises a platinum-group metal on a sulphated inorganic oxide such as titania. The light hydrocarbon feedstock contacts the catalyst at pressures of between atmospheric and 70 atmospheres, temperatures of about 50° to 300° C., LHSV from 0.2 to 5 $hr^{-1}$, and hydrogen-to-hydrocarbon molar ratios of from about 0.1 to 5. Usually isomerization yields a product having an increased concentration of branched hydrocarbons.

Heavier paraffins, waxy distillates and raffinates usually having a carbon number range of $C_7$–$C_{20}$ are isomerized to increase the branching of the hydrocarbons using catalyst compositions within the above definition of isomerization catalysts. Operating conditions include pressures of between about 20 and 150 atmospheres, higher temperatures than for light paraffins of about 200° to 450° C., LHSV from 0.2 to 10 $hr^{-1}$, and hydrogen-to-hydrocarbon molar ratios of from about 0.5 to 10.

Isomerization of isomerizable alkylaromatic hydrocarbons of the general formula $C_6H_{(6-n)}R_n$ (wherein R represents one or more aliphatic side chains, n represents the number of side chains), of which a $C_8$-aromatic mixture containing ethylbenzene and xylenes is preferred, is effected using a catalyst comprising one or more platinum-group metals, a refractory inorganic oxide, and preferably one or more zeolitic or non-zeolitic molecular sieves. The conditions comprise a temperature ranging from about 0° to 600° C. or more, and preferably in the range of from about 300° to 500° C. The pressure generally is from about 1 to 100 atmospheres absolute, preferably less than about 50 atmospheres and the liquid hourly space velocity is from about 0.1 to 30 $hr^{-1}$. The hydrogen/hydrocarbon mole ratio is about 0.5:1 to about 25:1 or more.

Transalkylation and disproportionation are effected with catalyst compositions comprising one or more Group VIII (8–10) metals and a refractory inorganic oxide. Optionally, the catalyst also contains a molecular sieve and one or more Group VIA (6) metals. Suitable feedstocks include single-ring aromatics, naphthalenes and light olefins, and the reaction yields more valuable products of the same hydrocarbon specie. Isomerization and transalkylation also may occur at the operating conditions of between 10 and 70 atmospheres, temperatures of about 200° to 500° C., and LHSV from 0.1 to 10 $hr^{-1}$. Hydrogen is optionally present at a molar ratio to hydrocarbon of from about 0.1 to 10.

In a catalytic dealkylation process wherein it is desired to cleave paraffinic side chains from aromatic nuclei without substantially hydrogenating the ring structure, relatively high temperatures in the range of about 450° to 600° C. are employed at moderate hydrogen pressures of about 20 to 70 bar and a liquid hourly space velocity of from about 0.1 to 20 $hr^{-1}$. Preferred catalysts comprise one or more Group VII (8–10) metals and a refractory inorganic oxide, and may contain a zeolitic molecular sieve. Particularly desirable dealkylation reactions contemplated herein include the conversion of methylnaphthalene to naphthalene and toluene and/or xylenes to benzene.

Catalyst compositions used in hydrocracking processes preferably contain a hydrogenation promoter such as one or more of Group VII (8–10) and Group VIB (6) metals, optionally a molecular sieve, and an inorganic-oxide matrix. A variety of feedstocks including atmospheric and vacuum distillates, cycle stocks and residues are cracked to yield lighter products at pressures of between 30 and 200 atmospheres, temperatures of about 200° to 450° C., LHSV from 0.1 to 10 $hr^{-1}$, and hydrogen-to-hydrocarbon molar ratios of from about 2 to 80.

A broad embodiment of the invention may be accordingly characterized as a hydrocarbon conversion process for upgrading a naphtha-boiling range feedstock to obtain an aromatics-containing, low-olefin product, which process comprises contacting the feedstock with a conversion catalyst comprising a supported metal component in a conversion zone in the presence of hydrogen at conversion conditions to obtain an olefin- and hydrogen-containing conversion zone effluent, heat exchanging the conversion zone effluent and the feedstock in a feed-effluent heat exchanger zone, withdrawing at least a portion of the conversion zone effluent from the heat exchanger zone, contacting the withdrawn conversion zone effluent in a saturation zone with a saturation catalyst at saturation conditions including a pressure of from about 100 kPa to 2 MPa, a liquid hourly space velocity of from about 1 to 40 and a temperature of from about 600° to 740° K to obtain a treated conversion zone effluent and further cooling the treated conversion zone effluent by indirect feed-effluent heat exchange prior to vapor-liquid separation and product recovery.

Reforming, the preferred hydroprocessing step, may be carried out in two or more fixed-bed reactors in sequence (including cyclic or swing-reactor units) or in moving-bed reactors with continuous catalyst regeneration. The process combination of the invention is useful in both embodiments. The reactants may contact the catalyst in upward, downward, or radial-flow fashion, with radial flow being preferred. Reforming operating conditions include a pressure of from about atmospheric to 60 atmospheres (absolute), with the preferred range being from atmospheric to 20 atmospheres and a pressure of below 10 atmospheres being especially preferred. Hydrogen is supplied to the reforming zone in an amount sufficient to correspond to a ratio of from about 0.1 to 10 moles of hydrogen per mole of hydrocarbon feedstock. The operating temperature generally is in the range of 530° to 840° K. The volume of the contained reforming catalyst corresponds to a liquid hourly space velocity of from about 0.5 to 40 $hr^{-1}$.

The normal naphtha feedstock to the preferred reforming embodiment of the process combination is a mixture comprising paraffins, naphthenes, and aromatics, and may comprise small amounts of olefins, boiling within the gasoline (naphtha) range of from about 120 to about 380° F. Feedstocks which may be utilized include straight-run naphthas, natural gasoline, synthetic naphthas, thermal gasoline, catalytically cracked gasoline, partially reformed naphthas or raffinates from extraction of aromatics. The distillation range generally is that of a full-range naphtha, having an initial boiling point typically from 0° to 100° C. and a 95%-distilled point of from about 160° to 230° C.; more usually, the initial boiling range is from about 40° to 80° C. and the 95%-distilled point from about 175° to 200° C. Generally the naphtha feedstock contains less than about 30 mass-% $C_6$ and lighter hydrocarbons, and usually less than about 20 mass-% $C_6$-, since the objectives of gasoline reformulation and benzene reduction are more effectively accomplished by processing higher-boiling hydrocarbons. $C_6$ and lighter hydrocarbons generally are upgraded more effectively by isomerization. The total paraffin content of the naphtha generally ranges between about 20 and 99 mass-%, with a more usual range for straight-run naphtha derived from crude oil being from about 50 to 80 mass-%.

The naphtha feedstock generally contains small amounts of sulfur and nitrogen compounds each amounting to less than 10 parts per million (ppm) on an elemental basis. Preferably the naphtha feedstock has been prepared from a contaminated feedstock by a conventional pretreating step such as hydrotreating, hydrorefining or hydrodesulfurization to convert such contaminants as sulfurous, nitrogenous and oxygenated compounds to $H_2S$, $NH_3$ and $H_2O$, respectively, which can be separated from hydrocarbons as by fractionation. This conversion preferably will employ a catalyst known to the art comprising an inorganic oxide support and metals selected from Groups VIB(6) and VII(9–10) of the Periodic Table. [See Cotton and Wilkinson, *Advanced Inorganic Chemistry*, John Wiley & Sons (Fifth Edition, 1988)]. Optimally, the pretreating step will provide the preferred reforming step with a hydrocarbon feedstock having low sulfur levels disclosed in the prior art as desirable, e.g., 1 ppm to 0.1 ppm (100 ppb). It is within the ambit of the present invention that this optional pretreating step be included in the present process combination.

The reforming catalyst conveniently is a dual-function composite containing a metallic hydrogenation-dehydrogenation component on a refractory support which provides acid sites for cracking, isomerization, and cyclization. The hydrogenation-dehydrogenation component comprises a supported platinum-group metal component, with a platinum component being preferred. The platinum may exist within the catalyst as a compound, in chemical combination with one or more other ingredients of the catalytic composite, or as an elemental metal. Best results are obtained when substantially all of the platinum exists in the catalytic composite in a reduced state. The catalyst may contain other metal components known to modify the effect of the preferred platinum component, including Group IVA (14) metals, other Group VII (8–10) metals, rhenium, indium, gallium, zinc, and mixtures thereof, with a tin component being preferred.

The refractory support of the reforming catalyst should be a porous, adsorptive, high-surface-area material which is uniform in composition. Preferably the support comprises refractory inorganic oxides such as alumina, silica, titania, magnesia, zirconia, chromia, thoria, boria or mixtures thereof, especially alumina with gamma- or eta-alumina being particularly preferred and best results being obtained with "Ziegler alumina" as described in the references. Optional ingredients are crystalline zeolitic aluminosilicates, either naturally occurring or synthetically prepared such as FAU, MEL, MFI, MOR, MTW (IUPAC Commission on Zeolite Nomenclature), and non-zeolitic molecular sieves such as the aluminophosphates of U.S. Pat. No. 4,310,440 or the silico-aluminophosphates of U.S. Pat. No. 4,440,871 (incorporated by reference). Further details of the preparation and activation of embodiments of the above reforming catalyst are disclosed in U.S. Pat. No. 4,677,094 (Moser et al.), which is incorporated into this specification by reference thereto.

In an advantageous alternative embodiment, the reforming catalyst comprises a large-pore molecular sieve. The term "large-pore molecular sieve" is defined as a molecular sieve having an effective pore diameter of about 7 angstroms or larger. Examples of large-pore molecular sieves which might be incorporated into the present catalyst include LTL, FAU, AFI, MAZ, and zeolite-beta, with a nonacidic L-zeolite (LTL) being especially preferred. An alkali-metal component, preferably comprising potassium, and a platinum-group metal component, preferably comprising platinum, are essential constituents of the alternative reforming catalyst. The alkali metal optimally will occupy essentially all of the cationic exchangeable sites of the nonacidic L-zeolite. Further details of the preparation and activation of embodiments of the alternative reforming catalyst are disclosed, e.g., in U.S. Pat. No. 4,619,906 (Lambert et al) and U.S. Pat. No. 4,822,762 (Ellig et al.), which are incorporated into this specification by reference thereto.

Olefin-containing reformate contained in the effluent of the reforming zone comprises the feed to the saturation zone. As used herein the term "reforming zone" refers basically to the catalytic reaction zone in which the reforming reactions are performed to the exclusion of product separation and recovery equipment, and the previously referred to heat exchange zone. The concentration of olefins in the reformate feed to the saturation zone depends on reforming feedstock, severity and operating conditions and generally is between about 0.2 and 3 mass-%, and more usually from about 0.3 to 2.5 mass-%. The saturation zone selectively hydrogenates generally more than about 50%, more usually 70%, and often 80% or more of the olefins in the reformate at relatively mild conditions to avoid saturation of aromatics. Aromatics saturation, principally yielding naphthenes is less than about 1 mass-% of the aromatics in the feed, and preferably essentially no net aromatic saturation occurs. The saturation zone contains a bed of catalyst which suitably comprises one or more of nickel and the platinum-group metals.

Contacting within the saturation zone may be effected using the catalyst in a fixed-bed system, a cyclic system with swing reactors, a moving-bed system, a fluidized-bed system, or in a batch-type operation. In view of the danger of attrition loss of the valuable catalyst and of operational advantages, it is preferred to use a fixed-bed system. The catalyst generally is contained in a single reactor, as the low level of olefins in the feed generally does not warrant multiple reactors with intermediate temperature control. The reactants may be contacted with the bed of catalyst particles in either upward, downward, or radial flow fashion. The reactants may be in the liquid phase, a mixed liquid-vapor phase, or a vapor phase when contacted with the catalyst particles; vapor-phase contacting is preferred considering the operating conditions of the invention.

Operating conditions in the saturation zone include pressures from about 1 atmosphere to 60 atmospheres absolute, preferably between about 1 and 20 atmospheres and more preferably from about 3 to 10 atmospheres. Liquid hourly space velocities (LHSV) range from about 1 to 100 $hr^{-1}$ and preferably up to about 40 $hr^{-1}$. Hydrogen to hydrocarbon ratios are determined by the requirements of the reforming zone and are usually in the range of about 1 to 10 on a molar basis although ratios of as low as 0.01 may be acceptable depending on the olefin content of the olefin-containing reformate.

It is an essential aspect of the invention that the operating temperature within the saturation zone be controlled to effect olefin saturation with minimal saturation of aromatics at between about 600° and 740° K by withdrawing the olefin-containing reformate as feed from an intermediate point in the feed-effluent heat exchanger associated with the reforming zone. The placement of the saturation zone was described hereinabove as between the hot-section and the cold-section combined-feed exchangers. The location of the saturation zone may be between exchanger shells or a point determined by withdrawing the feed from an intermediate point in a vertical feed-effluent exchanger such as that disclosed in U.S. Pat. No. 5,091,075, incorporated by reference.

Since the inlet and outlet temperature of the reforming zone vary as influenced by such parameters as feedstock type, severity, and stage of catalyst life, it is important that such variables be taken into account in selecting an operating-temperature range. Preferably the critical saturation-zone temperature is defined by:

minimum temperature, $$^{\circ}K=\{528/[1-0.021 \text{ In } (200*\{H_2 \text{ partial pressure}\}^3)]\}$$

and maximum temperature, $$^{\circ}K=\{827/[1-0.056 \text{ In } (0.4*H_2 \text{ partial pressure/mass-\% } C_6\text{+paraffins})]\}.$$

More preferably, the critical saturation-zone temperature is defined by:

minimum temperature, $$^{\circ}K=\{537/[1-0.021 \text{ In } (200*\{H_2 \text{ partial pressure}\}^3)]\}$$

and maximum temperature, $$^{\circ}K=\{810/[1-0.056 \text{ In } (0.4*H_2 \text{ partial pressure/mass-\% } C_6\text{+paraffins})]\}$$

where the hydrogen partial pressure and $C_6$-plus paraffin concentration is measured in the feed at the inlet to the saturation zone.

The saturation catalyst comprises an inorganic-oxide binder and a Group VIII (8–10) metal component. The refractory inorganic-oxide support optimally is a porous, adsorptive, high-surface-area support having a surface area of about 25 to about 500 $m^2/g$. The porous carrier material should also be uniform in composition and relatively refractory to the conditions utilized in the process. By the term "uniform in composition," it is meant that the support be unlayered, has no concentration gradients of the species inherent to its composition, and is completely homogeneous in composition. Thus, if the support is a mixture of two or more refractory materials, the relative amounts of these materials will be constant and uniform throughout the entire support. It is intended to include within the scope of the present invention refractory inorganic oxides such as alumina, titania, zirconia, chromia, zinc oxide, magnesia, thoria, boria, silica-alumina, silica-magnesia, chromia-alumina, alumina-boria, silica-zirconia and other mixtures thereof.

The preferred refractory inorganic oxide for use in the saturation catalyst of the present invention is alumina. Suitable alumina materials are the crystalline aluminas known as the gamma-, eta-, and theta-alumina, with gamma- or eta-alumina giving best results. Zirconia, alone or in combination with alumina, comprises an alternative inorganic-oxide component of the catalyst. The preferred refractory inorganic, oxide will have an apparent bulk density of about 0.3 to about 1.01 g/cc and surface area characteristics such that the average pore diameter is about 20 to 300 angstroms, the pore volume is about 0.05 to about 1 cc/g, and the surface area is about 50 to about 500 $m^2/g$.

A particularly preferred alumina is that which has been characterized in U.S. Pat. Nos. 3,852,190 and 4,012,313 as a byproduct from a Ziegler higher alcohol synthesis reaction as described in Ziegler's U.S. Pat. No. 2,892,858. For purposes of simplification, such an alumina will be hereinafter referred to as a "Ziegler alumina." Ziegler alumina is presently available from the Vista Chemical Company under the trademark "Catapal" or from Condea Chemie GMBH under the trademark "Pural." This material is an extremely high purity pseudo-boehmite powder which, after calcination at a high temperature, has been shown to yield a high-purity gamma-alumina.

The alumina powder may be formed into a suitable catalyst material according to any of the techniques known to those skilled in the catalyst-carrier-forming art. Spherical carrier particles may be formed, for example, from this Ziegler alumina by: (1) converting the alumina powder into an alumina sol by reaction with a suitable peptizing acid and water and thereafter dropping a mixture of the resulting sol and a gelling agent into an oil bath to form spherical particles of an alumina gel which are easily converted to a gamma-alumina carrier material by known methods; (2) forming an extrudate from the powder by established methods and thereafter, rolling the extrudate particles on a spinning disk until spherical particles are formed which can then be dried and calcined to form the desired particles of spherical carrier material; and (3) wetting the powder with a suitable peptizing agent and thereafter rolling the particles of the powder into spherical masses of the desired size. This alumina powder can also be formed in any other desired shape or type of carrier material known to those skilled in the art such as rods, pills, pellets, tablets, granules, extrudates, and like forms by methods well known to the practitioners of the catalyst material forming art.

The preferred form of carrier material for the saturation catalyst is a cylindrical extrudate. The extrudate particle is optimally prepared by mixing the alumina powder with water and suitable peptizing agents such as nitric acid, acetic acid, aluminum nitrate, and the like material until an extrudable dough is formed. The amount of water added to form the dough is typically sufficient to give a Loss on Ignition (LOI) at 500° C. of about 45 to 65 mass-%, with a value of 55 mass-% being especially preferred. The resulting dough is then extruded through a suitably sized die to form extrudate particles.

The extrudate particles are dried at a temperature of about 150° to about 200° C., and then calcined at a temperature of about 450° to 800° C. for a period of 0.5 to 10 hours to effect the preferred form of the refractory inorganic oxide. It is preferred that the refractory inorganic oxide comprise substantially pure gamma alumina having an apparent bulk density of about 0.6 to about 1 g/cc and a surface area of about 150 to 280 $m^2/g$ (preferably 185 to 235 $m^2/g$, at a pore volume of 0.3 to 0.8 cc/g).

An essential component of the preferred saturation catalyst is a platinum-group metal or nickel. Of the preferred platinum group, i.e., platinum, palladium, rhodium, ruthenium, osmium and iridium, palladium is a favored component and platinum is especially preferred. Mixtures of platinum-group metals also are within the scope of this invention. This component may exist within the final catalytic composite as a compound such as an oxide, sulfide, halide, or oxyhalide, in chemical combination with one or more of the other ingredients of the composite, or as an elemental metal. Best results are obtained when substantially all of this metal component is present in the elemental state. This component may be present in the final catalyst composite in any amount which is catalytically effective, and generally will comprise about 0.01 to 2 mass-% of the final catalyst calculated on an elemental basis. Excellent results are obtained when the catalyst contains from about 0.05 to 1 mass-% of platinum.

The platinum-group metal component may be incorporated into the saturation catalyst in any suitable manner such as coprecipitation or cogellation with the carrier material, ion exchange or impregnation. Impregnation using water-soluble compounds of the metal is preferred. Typical platinum-group compounds which may be employed are chloroplatinic acid, ammonium chloroplatinate, bromoplatinic acid, platinum dichloride, platinum tetrachloride hydrate, tetraamine platinum chloride, tetraamine platinum nitrate, platinum dichlorocarbonyl dichloride, dinitrodiaminoplatinum, palladium chloride, palladium chloride dihydrate, palladium nitrate, etc. Chloroplatinic acid is preferred as a source of the especially preferred platinum component.

It is within the scope of the present invention that the catalyst may contain other metal components known to modify the effect of the platinum-group metal component. Such metal modifiers may include rhenium, tin, germanium, lead, cobalt, nickel, indium, zinc, and mixtures thereof, with tin being a preferred component. Catalytically effective amounts of such metal modifiers may be incorporated into the catalyst by any means known in the art.

The composite is dried at a temperature of about 100° to 300°, followed by calcination or oxidation at a temperature of from about 375° to 600° C. in an air or oxygen atmosphere for a period of about 0.5 to 10 hours in order to convert the metallic components substantially to the oxide form.

The resultant oxidized catalytic composite is subjected to a substantially water-free and hydrocarbon-free reduction step. This step is designed to selectively reduce the platinum-group component to the corresponding metal and to insure a finely divided dispersion of the metal component throughout the carrier material. Substantially pure and dry hydrogen (i.e., less than 20 vol. ppm $H_2O$) preferably is used as the reducing agent in this step. The reducing agent is contacted with the oxidized composite at conditions including a temperature of about 425° C. to about 650° C. and a period of time of about 0.5 to 2 hours to reduce substantially all of the platinum-group metal component to its elemental metallic state.

The process combination produces a saturated reformate which usually is processed in a separation section, suitably comprising one or more fractional distillation columns having associated appurtenances known in the art. Such fractionation separates residual hydrogen and light gases which remain from the reforming zone and were introduced in the saturation zone, producing a stabilized reformate as a fractionator bottoms stream.

Preferably part or all of each of the saturated and stabilized reformate is blended with other gasoline constituents available in a refinery to obtain a component of finished gasoline. Such other constituents include but are not limited to one or more of butanes, butenes, pentanes, naphtha, catalytic reformate, isomerate, alkylate, polymer, aromatic extract, heavy olefins; gasoline from catalytic cracking, hydrocracking, thermal cracking, thermal reforming, steam pyrolysis and coking; oxygenates from sources outside the combination such as methanol, ethanol, propanol, isopropanol, TBA, SBA, MTBE, ETBE, MTAE and higher alcohols and ethers; and small amounts of additives to promote gasoline stability and uniformity, avoid corrosion and weather problems, maintain a clean engine and improve driveability. Alternatively the reformate is further processed for production of petrochemical intermediates, such as by extraction to recover aromatics, wherein a low olefin content is advantageous for product purity and ease of processing.

EXAMPLES

The following examples serve to illustrate certain specific embodiments of the present invention. These examples should not, however, be construed as limiting the scope of the invention as set forth in the claims. There are many possible other variations, as those of ordinary skill in the art will recognize, which are within the spirit of the invention.

Example 1

The olefin-containing reformate upon which the following calculation was based is an olefin-containing reformate having the following approximate characteristics:

| | |
|---|---|
| Specific gravity | 0.8178 |
| Distillation, ASTM D-86, ° C. | |
| IBP | 45 |
| 50% | 114 |
| 90% | 157 |
| EP | 181 |
| Mass-% | |
| paraffins | 19.4 |
| olefins | 1.91 |
| naphthenes | 0.2 |
| aromatics | 78.5 |
| $C_6$–$C_8$ aromatics | 56.1 |

Minimum and maximum saturation temperatures were set by the following formulae:
minimum temperature, $$° K=\{528/[1-0.021 \text{ In } (200*\{H_2 \text{ partial pressure}\}^3)]\}$$

maximum temperature, $$° K=\{827/[1-0.056 \text{ In } (0.4*H_2 \text{ partial pressure}/\% \ C_6+\text{paraffins})]\},$$

Olefin and aromatics ("aromatics"=$C_6$–$C_8$ aromatics) saturation levels were calculated at the minimum and maximum temperatures and at an intermediate level as follows based on a platinum-on-alumina saturation catalyst operating at a pressure of about 4.5 atmospheres absolute and a hydrogen/hydrocarbon mole ratio of 1.5:

| Case | Min. | Inter. | Max. |
|---|---|---|---|
| Temperature, ° C. | 369 | 410 | 451 |
| Olefins, mass-% | 0.066 | 0.17 | 0.48 |
| % removal | 96.5 | 91.1 | 74.9 |
| Aromatics, mass-% | 54.4 | 56.0 | 56.1 |

Example 2

A second olefin-containing reformate on which an evaluation was based had the following approximate characteristics:

| | |
|---|---|
| Specific gravity | 0.81 |
| Distillation, ASTM D-86, ° C. | |
| IBP | 43 |
| 50% | 113 |
| 90% | 136 |
| EP | 158 |
| Mass-% | |
| paraffins | 20.9 |
| olefins | 1.64 |
| naphthenes | 0.3 |
| aromatics | 77.2 |
| $C_6$–$C_8$ aromatics | 71.5 |

Minimum and maximum saturation temperatures were set by the following formulae:
minimum temperature, $$° K=\{528/[1-0.021 \text{ In } (200*\{H_2 \text{ partial pressure}\}^3)]\}$$

maximum temperature, $$° K=\{827/[1-0.056 \text{ In } (0.4*H_2 \text{ partial pressure}/\% \ C_6+\text{parraffins})]\},$$

Olefin and aromatics saturation levels were calculated at the minimum and maximum temperatures and at an intermediate level as follows based on a platinum-on-alumina catalyst operating at a pressure of about 4.5 atmospheres absolute and a hydrogen/hydrocarbon mole ratio of 3.5 ("aromatics"=$C_6$–$C_8$ aromatics):

| Case | Min. | Inter. | Max. |
|---|---|---|---|
| Temperature, ° C. | 371 | 404 | 440 |
| Olefins, mass-% | 0.08 | 0.16 | 0.36 |
| % removal | 95 | 90 | 78 |
| Aromatics, mass-% | 69.5 | 71.5 | 71.5 |

A preferred embodiment of the invention may accordingly be characterized as a catalytic reforming process for upgrading a naphtha feedstock to obtain an aromatics-enriched, low-olefin product comprising reforming the feedstock with a reforming catalyst comprising a supported platinum-group metal component in a reforming zone in the presence of hydrogen at reforming conditions to obtain an olefin-containing reformate stream comprising hydrogen, exchanging heat between the reformate and the feedstock in a first portion of a heat exchange zone, withdrawing at least an unseparated portion of the reformate stream from an intermediate point in the heat exchange zone, contacting the withdrawn reformate stream in a saturation zone with a saturation catalyst comprising a platinum-group metal component and a refractory inorganic oxide at saturation conditions including a pressure of from about 1 atmosphere to 20 atmospheres absolute, a liquid hourly space velocity of from about 1 to 40 $hr^{-1}$ and a temperature within the range as defined by:
minimum temperature, $$° K=\{528/[1-0.021 \text{ In } (200*\{H_2 \text{ partial pressure}\}^3)]\}$$

and
maximum temperature, $$° K=\{827/[1-0.056 \text{ In } (0.4*H_2 \text{ partial pressure/mass-\% } C_6+\text{paraffins})]\},$$

wherein $H_2$ partial pressure is expressed in atmospheres and $C_6$+paraffins as mass-% of the feedstock, to obtain a saturated reformate stream, returning the saturated reformate stream to the heat exchange zone and fractionating the saturated reformate to remove light hydrocarbons produced in the reforming zone and residual hydrogen remaining from the saturation zone and obtain a stabilized reformate.

We claim as our invention:

1. A reforming process for upgrading a naphtha feedstock to obtain an aromatics-enriched, low-olefin product comprising reforming the feedstock with a catalyst comprising a supported platinum-group metal component in a reforming zone in the presence of hydrogen at reforming conditions to obtain an olefin-containing reformate, exchanging heat between the reformate and the feedstock in a feed-effluent indirect heat exchange zone, withdrawing at least a portion of the reformate from an intermediate point in the heat exchange zone, contacting the withdrawn, unseparated reformate in a saturation zone with a saturation catalyst comprising a platinum-group metal component and a refractory inorganic oxide at saturation conditions including a pressure of from about 1 atmosphere to 20 atmospheres absolute, a liquid hourly space velocity of from about 1 to 40 $hr^{-1}$ and a temperature within a range as defined by:

minimum temperature, $$^{\circ}K=\{528/[1-0.021\ \mathrm{In}\ (200*\{H_2\ \text{partial pressure}\}^3)]\}$$

and maximum temperature, $$^{\circ}K=\{827/[1-0.056\ \mathrm{In}\ (0.4*H_2\ \text{partial pressure}/\%\ C_6\text{+paraffins})]\},$$

wherein $H_2$ partial pressure is expressed in atmospheres and $C_6$+paraffins as mass-% of the feedstock, to obtain a saturated reformate and returning the saturated reformate to the heat exchanger.

2. The process combination of claim 1 further comprising separating the saturated reformate by fractionation to remove light hydrocarbons produced in the reforming zone and residual hydrogen remaining from the saturation zone and obtain a stabilized product.

3. The process combination of claim 1 wherein the platinum-group metal component of the saturation catalyst comprises a platinum component.

4. The process combination of claim 1 wherein the saturation catalyst further comprises at least one metal component selected from elements of Groups VIB (6), VIII (8–10) and IVA (14) of the Periodic Table.

5. The process combination of claim 1 wherein the saturation conditions comprise a minimum temperature in ° K of $\{537/[1-0.021\ \mathrm{In}\ (200*\{H_2\ \text{partial pressure}\}^3)]\}$.

6. The process combination of claim 1 wherein the saturation conditions comprise a maximum temperature in ° K of $\{810/[1-0.056\ \mathrm{In}\ (0.4*H_2\ \text{partial pressure/mass-\%}\ C_6\text{+paraffins})]\}$.

7. A catalytic reforming process for upgrading a naphtha feedstock to obtain an aromatics-enriched, low-olefin product comprising reforming the feedstock with a reforming catalyst comprising a supported platinum-group metal component in a reforming zone in the presence of hydrogen at reforming conditions to obtain an olefin-containing reformate stream comprising hydrogen, exchanging heat between the reformate and the feedstock in a first portion of a heat exchange zone, withdrawing at least an unseparated portion of the reformate stream from an intermediate point in the heat exchange zone, contacting the withdrawn reformate stream in a saturation zone with a saturation catalyst comprising a platinum-group metal component and a refractory inorganic oxide at saturation conditions including a pressure of from about 1 atmosphere to 20 atmospheres absolute, a liquid hourly space velocity of from about 1 to 40 $hr^{-1}$ and a temperature within the range as defined by:

minimum temperature, $$^{\circ}K=\{528/[1-0.021\ \mathrm{In}\ (200*\{H_2\ \text{partial pressure}\}^3)]\}$$

and maximum temperature, $$^{\circ}K=\{827/[1-0.056\ \mathrm{In}\ (0.4*H_2\ \text{partial pressure/mass-\%}\ C_6\text{+paraffins})]\},$$

wherein $H_2$ partial pressure is expressed in atmospheres and $C_6$+paraffins as mass-% of the feedstock, to obtain a saturated reformate stream, returning the saturated reformate stream to the heat exchange zone and fractionating the saturated reformate to remove light hydrocarbons produced in the reforming zone and residual hydrogen remaining from the saturation zone and obtain a stabilized reformate.

* * * * *